US006634716B2

(12) United States Patent
Sander et al.

(10) Patent No.: US 6,634,716 B2
(45) Date of Patent: Oct. 21, 2003

(54) OFFICE CHAIR

(75) Inventors: Armin Sander, Waldstrasse 49, D-90763 Fürth (DE); Martin Potrykus, Bamberg (DE)

(73) Assignee: Armin Sander, Nuremberg (DE)

( * ) Notice: Subject to any disclaimer, the term of this patent is extended or adjusted under 35 U.S.C. 154(b) by 34 days.

(21) Appl. No.: 09/982,182

(22) Filed: Oct. 17, 2001

(65) Prior Publication Data

US 2002/0043864 A1 Apr. 18, 2002

(30) Foreign Application Priority Data

Oct. 17, 2000 (DE) ..... 100 51 479

(51) Int. Cl.[7] ..... A47C 7/50

(52) U.S. Cl. ..... 297/423.19; 297/241; 297/423.12; 297/423.21

(58) Field of Search ..... 297/240, 241, 297/423.12, 423.13, 423.19, 423.21, 423.22, 423.24, 423.25

(56) References Cited

U.S. PATENT DOCUMENTS 38,718 A * 5/1863 Watson ..... 297/423.2
1,352,409 A * 9/1920 Hoefener ..... 297/241
1,686,464 A * 10/1928 Perry ..... 297/241
2,446,376 A * 8/1948 Littlejohn ..... 297/241
2,554,852 A * 5/1951 Bryan et al. ..... 297/241
2,762,422 A * 9/1956 Stratton ..... 297/423.22
5,727,848 A 3/1998 Gazard

FOREIGN PATENT DOCUMENTS

DE 3005616 * 8/1981 ..... 297/241
DE 39 91 487 C1 4/1994
FR 1315414 * 12/1962 ..... 297/423.22

* cited by examiner

*Primary Examiner*—Peter R. Brown
(74) *Attorney, Agent, or Firm*—Laurence A. Greenberg; Werner H. Stemer; Ralph E. Locher

(57) ABSTRACT

A footrest is fastened via a telescopically extendable connecting element to an office chair, in particular to an office chair having a backrest that can be tilted into a rest position. This results in an especially comfortable and ergonomic seating position, and in particular a situation in which the office chair is pushed away from the footrest when the footrest is not needed.

13 Claims, 2 Drawing Sheets

OFFICE CHAIR

BACKGROUND OF THE INVENTION

Field of the Invention

The invention relates to an office chair, in particular an office chair having a backrest that can be tilted into a rest position.

As a rule, such an office chair is configured as an office swivel chair and has various forms of adjustment in order to permit a high degree of seating comfort. Modern office swivel chairs are provided with a "synchronous mechanism" via which a seat can be combined with the backrest in such a way that the seat is oriented in an ergonomic manner in each tilted position of the backrest. On account of the tilting capacity of the backrest, the office chair can be shifted into a rest position. In order to permit a position which is as relaxed as possible, it is advantageous if the feet can be put on a footrest. Such a footrest is configured, for example, as a separate piece of furniture or is fastened to a writing table. U.S. Pat. No. 5,727,848 discloses a chair for a computer workplace having a footrest fastened to the seat of the chair via an extendable rod.

SUMMARY OF THE INVENTION

It is accordingly an object of the invention to provide an office chair that overcomes the above-mentioned disadvantages of the prior art devices of this general type, having a high degree of comfort.

With the foregoing and other objects in view there is provided, in accordance with the invention, an office chair. The office chair contains a backrest which can be tilted into a rest position, a support column supporting the backrest, a footrest, and a telescopically extendable connecting element connected on a first end to the support column and on a second end to the footrest. The connecting element is extendable from a basic position into an extended position. The connecting element has a restoring element exerting a restoring force on the connecting element in a direction of the basic position.

The object is achieved according to the invention by the office chair, in particular by the office chair having a backrest that can be tilted into a rest position. The footrest is fastened to the office chair via the telescopically extendable connecting element that is extendable from the basic position into the extended position. In this case, the restoring element configured in particular as a spring element is provided. The restoring element exerts a restoring force on the connecting element in the direction of the basic position of the connecting element.

The fastening of the footrest to the office chair, compared with a footrest configured as a separate piece of furniture, achieves the advantage that, when the feet are supported on the footrest, the office chair is not pushed away from the footrest. The distance between the footrest and the office chair therefore stays the same. Furthermore, associated with the telescopic extendability is the advantage that the footrest can be positioned at different distances from the office chair and, can be pulled up to the office chair in a space-saving manner when it is not required. The configuration of the restoring element is especially useful, since in this way the footrest is automatically retracted into the basic position when it is not required. In addition, favorable ergonomic positioning of the footrest is automatically effected without manual adjustments having to be made. In particular, an ergonomically favorable adjustment to different users is effected, or if a user changes his seating position, for example by leaning back.

For a simple configuration of the connecting element, it is preferably configured as a telescopic tube.

In this case, the connecting element is expediently configured in such a way that it is moved evenly from the extended position into the basic position. The automatic retraction of the connecting element, in particular, is therefore not effected suddenly, and is also effected sufficiently slowly, in order not to form any source of danger due to the footrest springing back too quickly.

In this case, a valve is expediently provided on the telescopic tube, and the valve has a large outflow resistance, compared with the inflow resistance, for the air flowing out of the telescopic tube during the movement into the basic position. The outflowing air is thus choked and provides for uniform retraction into the basic position. The valve is preferably configured as a simple check valve that clears an air opening in the telescopic tube when the telescopic tube is being extended. When the telescopic tube is being retracted, the check valve at least partly covers the air opening.

In an expedient development, the extension length of the connecting element is adjustable. In preferred variants, the adjustability has a displacement limit and/or a fixing device. With the displacement limit, extension of the connecting element beyond a desired extension length is prevented. It thus permits an optimum adaptation to the body size of a person using the office chair. The fixing device, in addition to the displacement limit, additionally achieves the effect that the footrest—if desired—is not automatically retracted and remains in a predefined position.

In an especially advantageous embodiment variant, the connecting element is fastened so as to be pivotable about a perpendicular chair axis. This makes it possible to bring the footrest around the office chair into a rear position when it is not required in order to prevent the footrest from getting in the way in the foot region of the office chair.

The connecting element is also expediently pivotable in a plane spread out by the chair axis and the connecting element in order to be able to compensate for any possible unevenness in the floor.

For as simple a fastening of the connecting element as possible, the connecting element is fastened to, in particular clipped onto, a supporting column of the office chair, the supporting column holding a seat carrier. As an alternative to this, the connecting element may also be fastened directly to the seat carrier. With the fastening to the seat carrier, especially stable mechanical guidance of the connecting element is possible.

For a mechanically simple and robust embodiment, a supporting element for supporting the footrest on the floor is provided on the connecting element at the foot end in the region of the footrest. The force exerted on the footrest is therefore transmitted via the supporting element to the floor and does not need to be absorbed via the fastening to the office chair. In order to ensure the mobility of the footrest, the supporting element has casters.

As an alternative to this, the footrest is fastened to the office chair in a freely floating manner, that is to say without a supporting element on the floor. The seat carrier, on account of the stable mechanical guidance for the connecting element, is suitable for the freely floating fastening.

In order to permit an ergonomic seating position that is as comfortable as possible, the footrest contains a pivotable foot support which, in particular by a spring, is held in an initial position and/or can be latched in a pivoted position. In addition to or as an alternative to the spring element, the pivoting capacity is kept tight on account of friction forces.

Other features which are considered as characteristic for the invention are set forth in the appended claims.

Although the invention is illustrated and described herein as embodied in an office chair, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
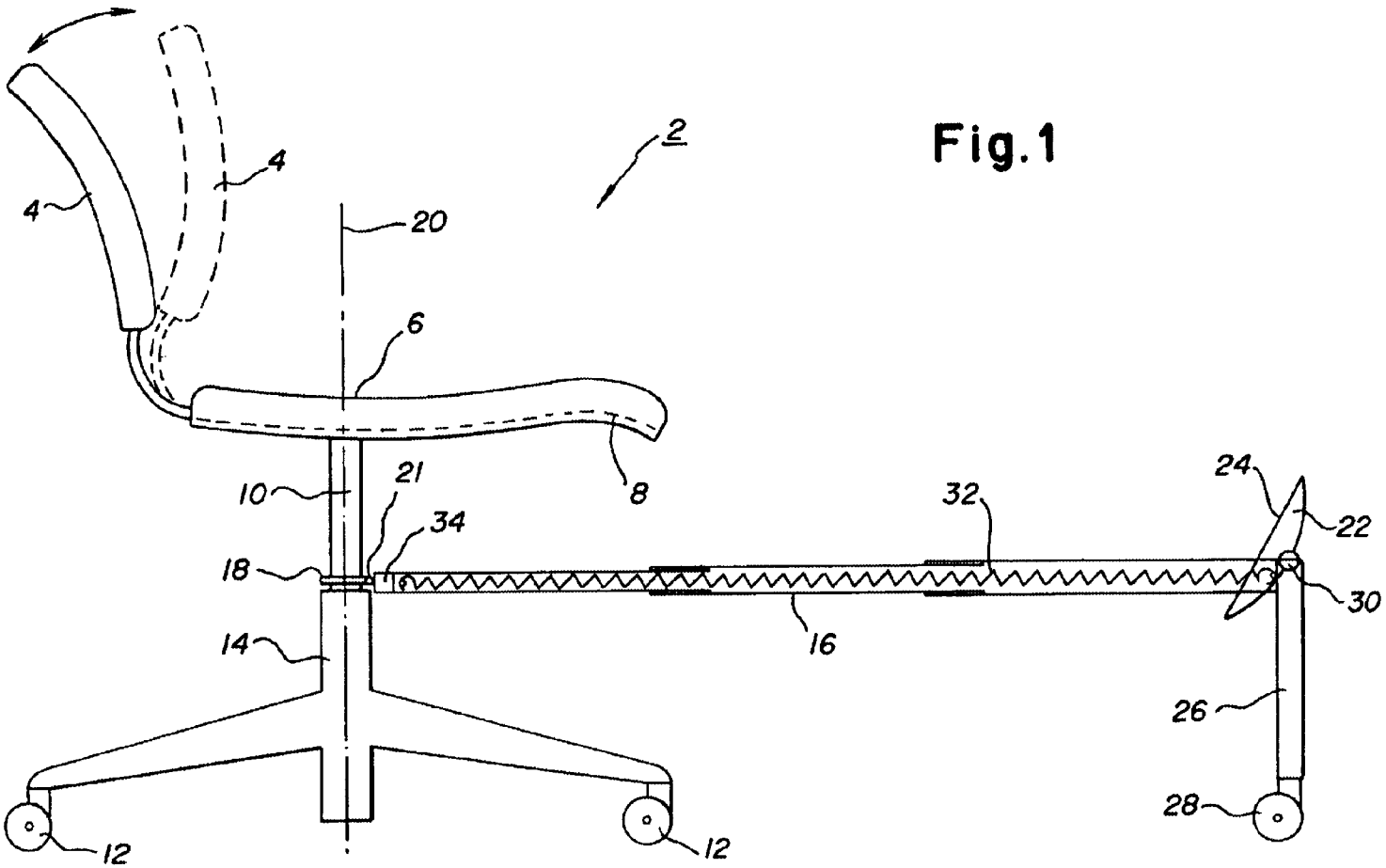
FIG. 1 is a diagrammatic, side-elevational view of an office chair with a footrest, which is attached thereto via a connecting element, in an extended position, according to the invention.

Referring now to the figures of the drawing in detail and first, particularly, to FIG. 1 thereof, there is shown in a greatly simplified manner an office chair 2, in particular an office swivel chair, that has a backrest 4 and a seat 6. The seat 6 is held by a seat carrier 8 (shown by broken line). The seat carrier 8 is connected via a vertically adjustable supporting column 10 to a pedestal 14 mounted on casters 12. The backrest 4 can be tilted into a rest position, as shown in FIG. 1. In this case, the office chair 2 has in particular a "synchronous mechanism" which connects the backrest 4 and the seat carrier 8 to one another in such a way that, when the backrest 4 is adjusted, the seat carrier 8 is at the same time adjusted in an especially ergonomic manner.

A connecting element configured as a telescopic tube 16 is fastened to the supporting column 10, in particular by being clipped on, by a fastening element 18. In this case, the fastening element 18 preferably encloses the supporting column 10 in a loose manner, so that the connecting element can be pivoted about a perpendicular chair axis 20 running through the supporting column 10. The fastening element 18 is connected to the telescopic tube 16 via a joint 21. The joint 21 permits pivoting of the telescopic tube 16 in a plane spread out by the chair axis 20 and the telescopic tube 16. The telescopic tube 16 can therefore be pivoted relative to the horizontal, so that, for example, unevenness in the floor can be compensated for.

At the foot end, a footrest 22 having a foot support 24 is disposed on the telescopic tube 16. The footrest 22 is supported on a floor (not shown in any more detail) via a supporting element 26 and a caster 28. The foot support 24 formed in one piece with the footrest 22 is held in a pivotable manner on the supporting element 26 via a swivel joint 30. The pivoting capacity is kept tight, for example by an adjustable friction force. In addition, the inclination of the foot support 24 can be fixed by corresponding latching in the swivel joint 30. As an alternative to this, it is possible to provide a spring 33 in the swivel joint, and this spring 33 brings the foot support 24 in each case into a predefined initial position when not in use.

Figure 2:
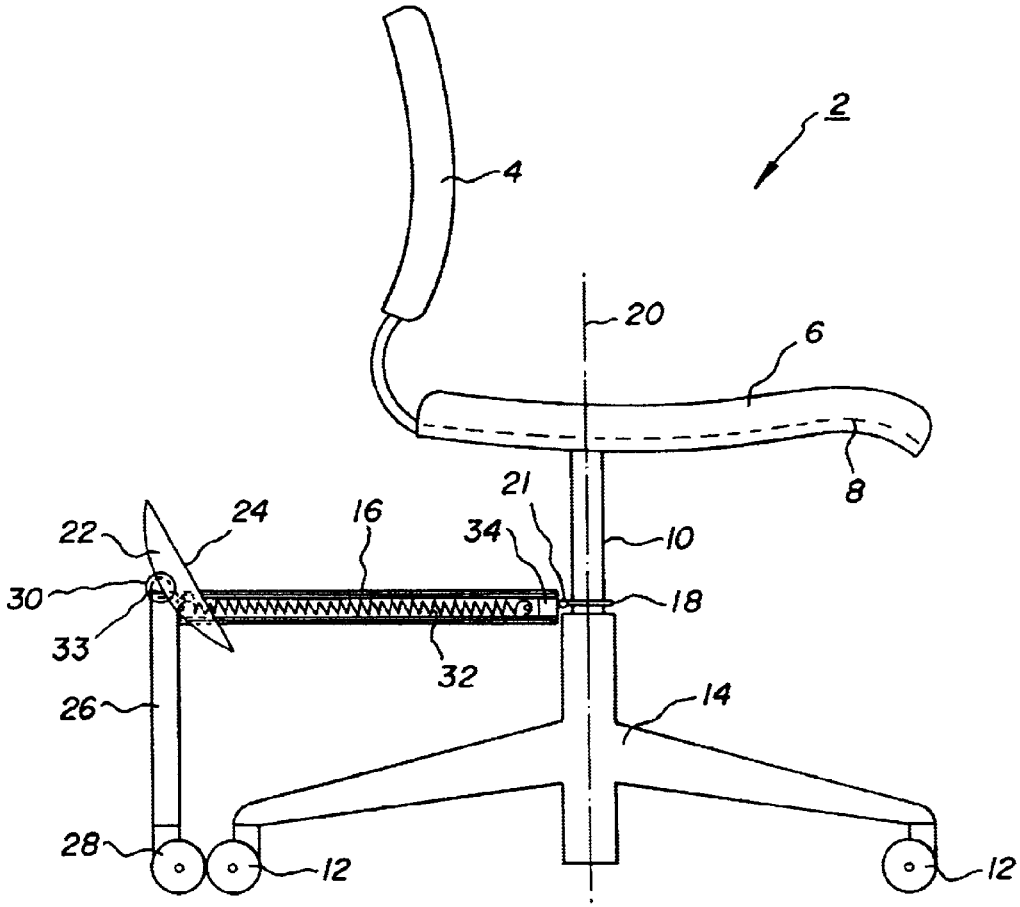
FIG. 2 is a side-elevational view of the office chair according to FIG. 1 with the footrest in a retracted basic position.

Provided in the telescopic tube 16 is a spring element 32 that automatically retracts the footrest 22 from an extended position according to FIG. 1 into a retracted position according to FIG. 2. It is additionally shown in FIG. 2 that the footrest 22 is swung to the rear side of the office chair 2 in order not to get in the way in the front foot region.

The spring element 32 is preferably configured in such a way that the footrest 22 is moved evenly and sufficiently slowly from the extended position into the basic position in order not to represent a risk of injury. A valve 34, shown schematically, is provided in order to assist the even retraction. This causes the air which is to be displaced from the telescopic tube 16 during the retraction into the basic position to escape slowly and evenly, so that the footrest 22 does not spring back suddenly into the basic position. The valve 34 is configured as a simple check valve for example.

Furthermore, provision is preferably made for the extension length of the telescopic tube 16 to be adjustable and in particular fixable. It is thus possible, on the one hand, to limit the distance between the footrest 22 and the seat 6, so that the footrest is not pushed away from the office chair to an undesirable extent. On the other hand, automatic retraction into the basic position is prevented by the fixing device.

The office chair 2 with the footrest directly attached thereto has the substantial advantage that the office chair 2 mounted on the casters 12 cannot be pushed away when using the footrest 22 on account of the muscle power exerted on the footrest 22. A distance between the footrest 22 and the seat 6 is therefore kept constant. In addition, the footrest 22 is always directly accessible and can be positioned in an ergonomically favorable manner relative to the seat 6. Operation is also especially user-friendly, since the footrest 22 can be extended in a simple manner by muscle power when required from the retracted basic position into the desired extended position. In addition, due to the pivoting capacity about the chair axis 20, the footrest 22 can be put away in a space-saving manner. Given a suitable subdivision of the individual telescopic elements of the telescopic tube 16, the footrest 22 can also be pulled nearer to the supporting column 10 than as shown in FIG. 2. It is thus possible to pull the footrest near to the supporting column 10 in such a way that it does not project beyond the pedestal 14.

We claim:

1. An office chair, comprising:

a backrest which can be tilted into a rest position;

a support column supporting said backrest;

a footrest; and a connecting element, wherein said connecting element is a telescopic tube connected on a first end to said support column and on a second end to said footrest, said telescopic tube being extendable from a basic position into an extended position, said telescopic tube having a restoring element exerting a restoring force on said telescopic tube in a direction of the basic position, and said telescopic tube having a valve with a, large outflow resistance compared with an inflow resistance, for air flowing out of said telescopic tube during movement into the basic position.

2. The office chair according claim 1, wherein said connecting element is configured such that it is moved evenly from the extended position into the basic position.

3. The office chair according to claim 1, wherein said connecting element has an adjustable extension length.

4. The office chair according to claim 1, wherein said connecting element is fastened so as to be pivotable about a perpendicular chair axis.

5. The office chair according to claim 1, wherein said connecting element is fastened in a pivotable manner in a plane spread out by said connecting element and a perpendicular chair axis.

6. The office chair according to claim 1, including a seat carrier held by said supporting column and supporting said backrest, said connecting element is clipped onto said supporting column.

7. The office chair according to claim 1, including a supporting element for supporting said footrest on a floor, said supporting element connected to said connecting element at said second end in a region of said footrest.

8. The office chair according to claim 7, including at least one caster supporting said supporting element.

9. The office chair according to claim 1, wherein said footrest is pivotably fastened to said connecting element.

10. The office chair according to claim 1, wherein said footrest has a spring for biasing said foot support to an initial position.

11. The office chair according to claim 1, wherein said restoring element is a spring element.

12. A footrest assembly for fastening to an office chair, comprising:

a footrest; and a telescopic tube connected on a first end to said support column and on a second end to said footrest, said telescopic tube being extendable from a basic position into an extended position, said telescopic tube having a restoring element exerting a restoring force on said telescopic tube in a direction of the basic position, and said telescopic tube having a valve with a large outflow resistance compared with an inflow resistance, for air flowing out of said telescopic tube during movement into the basic position.

13. An office chair, comprising:

a backrest which can be tilted into a rest position;

a seat carrier supporting said backrest;

a footrest; and a telescopic tube connected on a first end to said support column and on a second end to said footrest, said telescopic tube being extendable from a basic position into an extended position, said telescopic tube having a restoring element exerting a restoring force on said telescopic tube in a direction of the basic position, and said telescopic tube having a valve with a large outflow resistance compared with an inflow resistance, for air flowing out of said telescopic tube during movement into the basic position.

* * * * *